US007167761B2

(12) United States Patent
Wise et al.

(10) Patent No.: US 7,167,761 B2
(45) Date of Patent: Jan. 23, 2007

(54) METHODS AND SYSTEMS FOR MODIFYING THE OPERATION OF A COMPRESSOR VIA A PORTABLE MEMORY DEVICE

(75) Inventors: Brian D. Wise, Charlotte, NC (US); Vipul R. Mistry, Charlotte, NC (US); Laurie Meyrick, Lostock, Bolton (GB); John H. Alday, Charlotte, NC (US); Andy J. Burris, Kannapolis, NC (US); Regis Giraud, Angouleme (FR); Jean Marc Petillion, Fleac (FR)

(73) Assignee: Ingersoll-Rand Company, Montvale, NJ (US)

( * ) Notice: Subject to any disclaimer, the term of this patent is extended or adjusted under 35 U.S.C. 154(b) by 42 days.

(21) Appl. No.: 11/051,046

(22) Filed: Feb. 4, 2005

(65) Prior Publication Data

US 2006/0089734 A1 Apr. 27, 2006

Related U.S. Application Data

(60) Provisional application No. 60/621,985, filed on Oct. 25, 2004.

(51) Int. Cl.

| | |
|---|---|
| ***G05B 19/18*** | (2006.01) |
| *G06F 14/00* | (2006.01) |
| *G06F 13/00* | (2006.01) |
| *G06F 13/28* | (2006.01) |

(52) U.S. Cl. ..... 700/66; 700/5; 700/65; 700/170; 711/104; 711/115; 711/154; 711/170; 714/30; 358/1.16

(58) Field of Classification Search ..... 700/19, 700/2–3, 4–5, 65, 66, 56, 59, 170; 714/30; 709/217; 711/115, 104, 154, 167, 170; 702/1, 702/57; 358/1.16, 1.11

See application file for complete search history.

(56) References Cited

U.S. PATENT DOCUMENTS

| | | | |
|---|---|---|---|
| 4,593,376 | A | 6/1986 | Volk |
| 4,816,904 | A | 3/1989 | McKenna et al. |
| 5,251,324 | A | 10/1993 | McMullan, Jr. |

(Continued)

FOREIGN PATENT DOCUMENTS

| | | |
|---|---|---|
| EP | 1496264 | 1/2005 |

*Primary Examiner*—Ramesh Patel
(74) *Attorney, Agent, or Firm*—Michael Best & Friedrich LLP

(57) ABSTRACT

A method and system for modifying the operation a device. The method can include obtaining a first reconfiguration kit. The first reconfiguration kit can include a portable memory device. The method can also include connecting the portable memory device to the device and transmitting information between the portable memory device and the device. The method can further include disconnecting the portable memory device from the device and returning the portable memory device to an entity associated with the provider of the portable memory device.

45 Claims, 5 Drawing Sheets

U.S. PATENT DOCUMENTS 5,307,463 A 4/1994 Hyatt et al.
5,617,531 A * 4/1997 Crouch et al. ..... 714/30
5,632,681 A 5/1997 Bakoglu et al.
5,652,544 A * 7/1997 Fink ..... 330/65
5,677,953 A 10/1997 Dolphin
5,801,364 A 9/1998 Kara et al.
5,848,296 A 12/1998 Suzuki
5,911,121 A 6/1999 Andrews
5,923,884 A 7/1999 Peyret et al.
5,991,510 A 11/1999 Beaulieu
5,999,908 A 12/1999 Abelow
6,018,806 A 1/2000 Cortopassi et al.
6,055,631 A 4/2000 Chadha
6,212,635 B1 4/2001 Reardon
6,434,960 B1 8/2002 Rousseau
6,475,180 B1 11/2002 Peterson et al.
6,601,139 B1 7/2003 Suzuki
6,704,864 B1 3/2004 Philyaw
6,714,921 B1 3/2004 Stefik et al.
6,725,260 B1 4/2004 Philyaw
6,739,146 B1 5/2004 Davis et al.
6,789,030 B1 * 9/2004 Coyle et al. ..... 702/77
6,851,621 B1 * 2/2005 Wacker et al. ..... 236/51
2001/0037431 A1 * 11/2001 Hamamoto et al. ..... 711/115
2004/0020226 A1 2/2004 Bash et al.
2004/0084179 A1 5/2004 Watson et al.
2004/0133653 A1 * 7/2004 Defosse et al. ..... 709/217

* cited by examiner

METHODS AND SYSTEMS FOR MODIFYING THE OPERATION OF A COMPRESSOR VIA A PORTABLE MEMORY DEVICE

RELATED APPLICATIONS

The present application claims priority to U.S. provisional patent application Ser. No. 60/621,985 titled "METHODS AND SYSTEMS FOR MODIFYING THE OPERATION OF A COMPRESSOR VIA A PORTABLE MEMORY DEVICE," filed on Oct. 25, 2004.

FIELD OF INTEREST

The present invention relates to configuring and modifying operating characteristics of compressors. More particularly, embodiments of the invention relate to modifying the operating characteristics of a compressor using a portable memory device.

BACKGROUND OF THE INVENTION

In traditional compressors, operating parameters (i.e., speed, pressure, power, etc.) are set with a motor/compressor sheave or gear ratios. The motor/compressor sheave or gear ratios can be set for specific parameters to enable operation of a compressor at a specific capacity up to a maximum pressure within the available power limit. The parameters are often set during manufacture or construction of the compressor and typically cannot be easily modified once set. In some situations, the only way to change the characteristics of a compressor is to change mechanical components of the compressor.

SUMMARY OF THE INVENTION

Variable compressors are often used to overcome the above-identified limitations. In some variable compressors, the bulky mechanical gear assemblies or belt/sheave assemblies are replaced with "electronic gears" consisting of a variable speed drive ("VSD") and an electric motor. Variable compressors can then be programmed for a specific pressure and speed duty by variably setting the operating parameters of the VSD and motor. In traditional VSD controlled compressors, a controller or interface is included with the compressor to allow a user to program and customize the operation of the compressor. The controller and display, however, can be very expensive and a user can need specific training to adjust the operating characteristics of the compressors. Also, a user manually specifying operating characteristics can configure or program the compressor to operate outside approved operating parameters.

Embodiments of the invention provide a system for configuring operating parameters of a compressor. The system includes a compressor with a variable speed drive and a portable memory device interface and a portable memory device with a memory module and an external output port. The memory module of the portable memory device may have stored within it operating characteristics for the compressor. The external output port is connectable to the portable memory device interface of the compressor. Operating characteristics may be downloaded from the memory module of the portable memory device to the compressor. The compressor then operates according to the downloaded operating characteristics. The portable memory device can be removed or disconnected from the compressor once the operating characteristics are downloaded. The portable memory device can also be returned to a distribution or service center where it can be reprogrammed as needed.

Additional embodiments provide a method of configuring a compressor. The method may include connecting a portable memory device to the compressor, where the portable memory device includes operating characteristics for the compressor. The method may also include downloading the operating characteristics from the portable memory device to the compressor and modifying the operating parameters of the compressor based on the downloaded operating characteristics. The method may further include marking the portable memory device as used and removing the portable memory device from the compressor. The method may also include returning the portable memory device to a distribution or service center where it can be reprogrammed.

Another embodiment provides a method of configuring a variable-operating device. The method may include connecting a portable memory device to the variable-operating device, where the portable memory device includes operating characteristics for the variable-operating device. The method may also include downloading the operating characteristics from the portable memory device to the variable-operating device and modifying the operating parameters of the variable-operating device based on the downloaded operating characteristics. The method may further include marking the portable memory device as used and removing the portable memory device from the variable-operating device. The method may also include returning the portable memory device to a distribution or service center where it can be reprogrammed.

Yet another embodiment provides a system for modifying the operation of a compressor. The system can include a compressor controller configured to operate the compressor according to operating parameters and a portable memory device including a counter to track use of the portable memory device. The system can also include a first portable memory device interface configured to transmit information between the portable memory device and the compressor controller and to set the counter. The portable memory device configured to be connected to the first portable memory device interface, and the compressor controller configured to modify the operating parameters based on the information and to operate the compressor according to the modified operating parameters.

Additional embodiments provide a method of modifying the operation a first device. The method can include connecting a portable memory device to the first device. The portable memory device can include a counter value to track use of the portable memory device. The method can also include transmitting information between the portable memory device and the first device, modifying operating parameters of the first device based on the information, and setting the counter value of the portable memory device. The method can further include disconnecting the portable memory device from the first device and operating the first device with the modified operating parameters.

Further embodiments also provide a method of modifying the operation a device. The method can include obtaining a first reconfiguration kit. The first reconfiguration kit can include a portable memory device. The method can also include connecting the portable memory device to the device, transmitting information between the portable memory device and the device, and disconnecting the portable memory device from the device. The method can further include returning the portable memory device to an entity associated with the provider of the portable memory device.

Furtherstill, embodiments provide a portable memory device. The portable memory device can include a memory module configured to store a counter value for tracking the use of the portable memory device, an external output connector connectable with an external access connector of a device. The external output connector can be configured to transmit information between the device and the memory module when the external output connector is connected to the external access connector of the device.

Other features and advantages of the invention will become apparent to those skilled in the art upon review of the detailed description, claims, and drawings.

DETAILED DESCRIPTION

Figure 1:
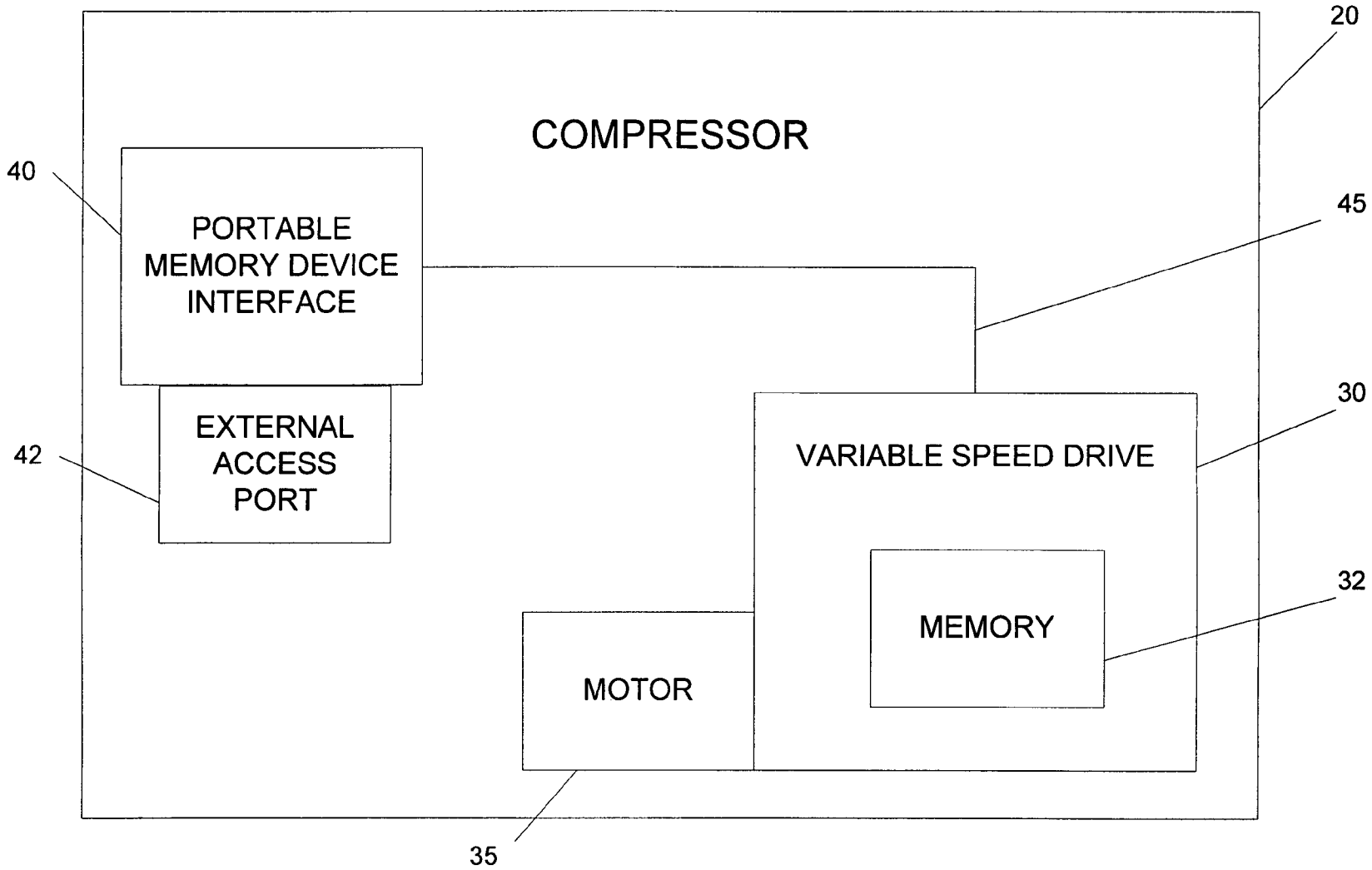
FIG. 1 is a schematic illustration of an exemplary variable-operating device.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

FIG. 1 illustrates an exemplary variable-operating device in the form of a compressor 20. It should be understood that the device 10 can be devices configured to provide or operate at a range of selectable operating parameters (e.g., speed, power, pressure, etc.) can be substituted for the compressor 20. The compressor 20 can include a compressor controller, such as a variable speed drive ("VSD") 30. The compressor 20 can also include a memory 32, a motor 35, and a portable memory device interface 40. In some embodiments, the VSD 30 drives the motor 35 to provide horsepower ("HP") of approximately 7.5 HP to 15 HP and can generate approximately 115 pounds per square inch ("PSI") to 150 PSI of pressure.

The memory 32 can be configured to store operating parameters of the VSD 30. The memory 32 can store a HP or PSI designation that regulates how the VSD 30 operates. The memory 32 can also include possible operating parameters configurations for the VSD 30, and the VSD 30 can select one of the configurations and operate according to the parameters specified in the configuration. It should be noted that although the memory 32 is illustrated as internal to the VSD 30, the memory 32 can be located external to the VSD 30.

In some embodiments, the portable memory device interface 40 includes an external access connector 42. In some embodiments, the external access connector 42 includes an RJ45 female port. The portable memory device interface 40 can be configured to transmit information between an external device connected to the external access connector 42. The information can include operating characteristics (i.e., speed characteristics, power characteristics, pressure characteristics, etc.). After obtaining operating characteristics from an external device connected to the external access connector 42, the operating characteristics can be transmitted to the VSD 30 over a connection 45. The VSD 30 can store the operating characteristics to the memory 32. The VSD 30 can also modify the operating parameters stored in the memory 32 based on the operating characteristics.

It should be understood that the compressor 20 can include additional components or a subset of those components illustrated and described above. The functionality provided by the components described above can also be combined and distributed in a variety of configurations.

Figure 2:
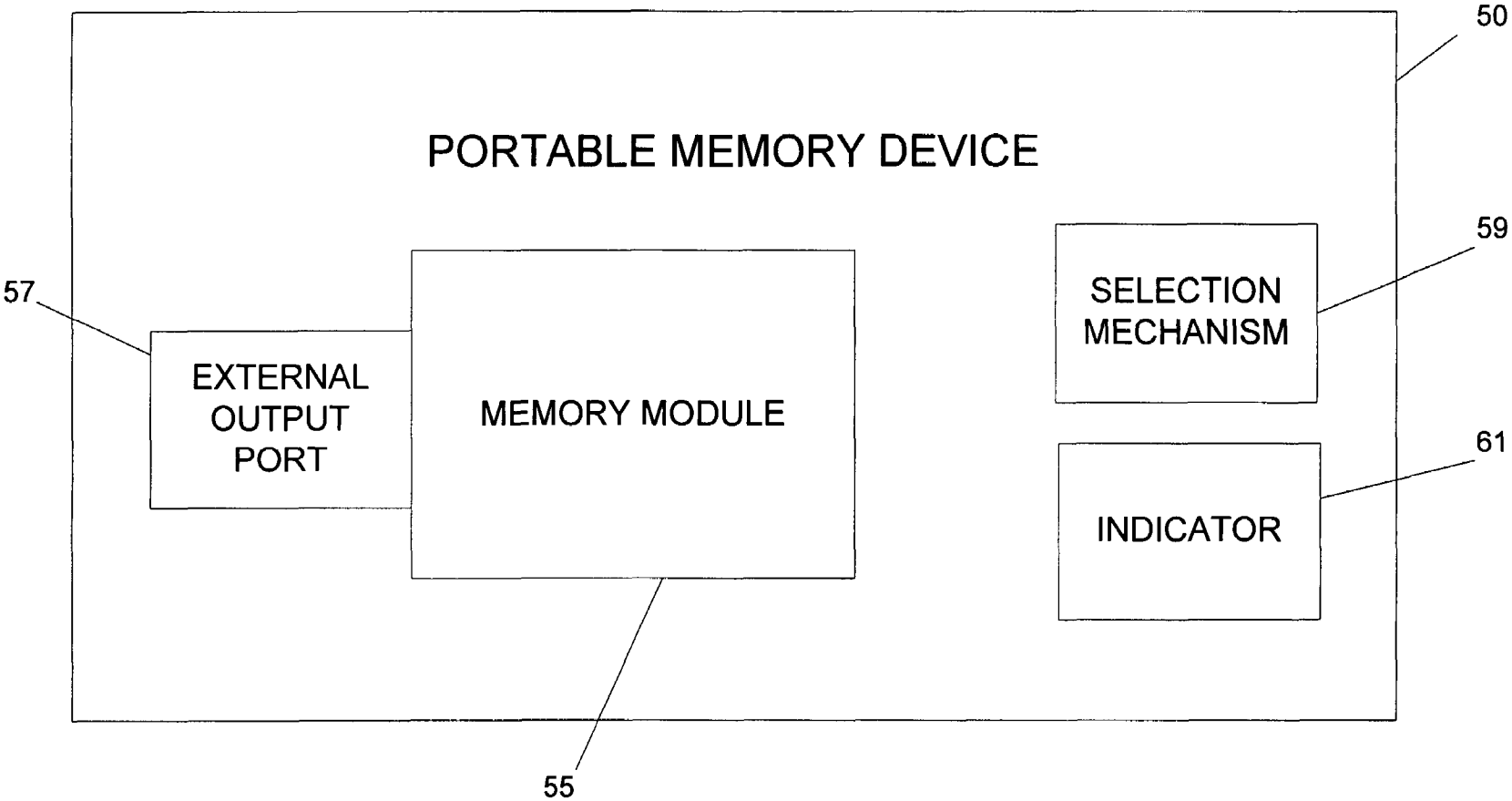
FIG. 2 is a schematic illustration of an exemplary portable memory device.

FIG. 2 illustrates an exemplary portable memory device 50 connectable to the compressor 20. In some embodiments, the portable memory device 50 includes a memory module 55, an external output connector 57, a button or selection mechanism 59, and an indicator 61. The memory module 55 can include non-volatile memory such as one or more forms of ROM, one or more disk drives, RAM, other memory, or combinations of the foregoing. The memory module 55 can store operating characteristics. In some embodiments, the memory module 55 stores operating characteristics that the compressor 20 can use to set operating parameters for the VSD 30. The operating characteristics can specify pressure and/or speed parameters at which the compressor 20 will operate. The operating characteristics can also specify, either directly or indirectly, the power consumption and thus a model designation of the compressor 20.

Figure 3:
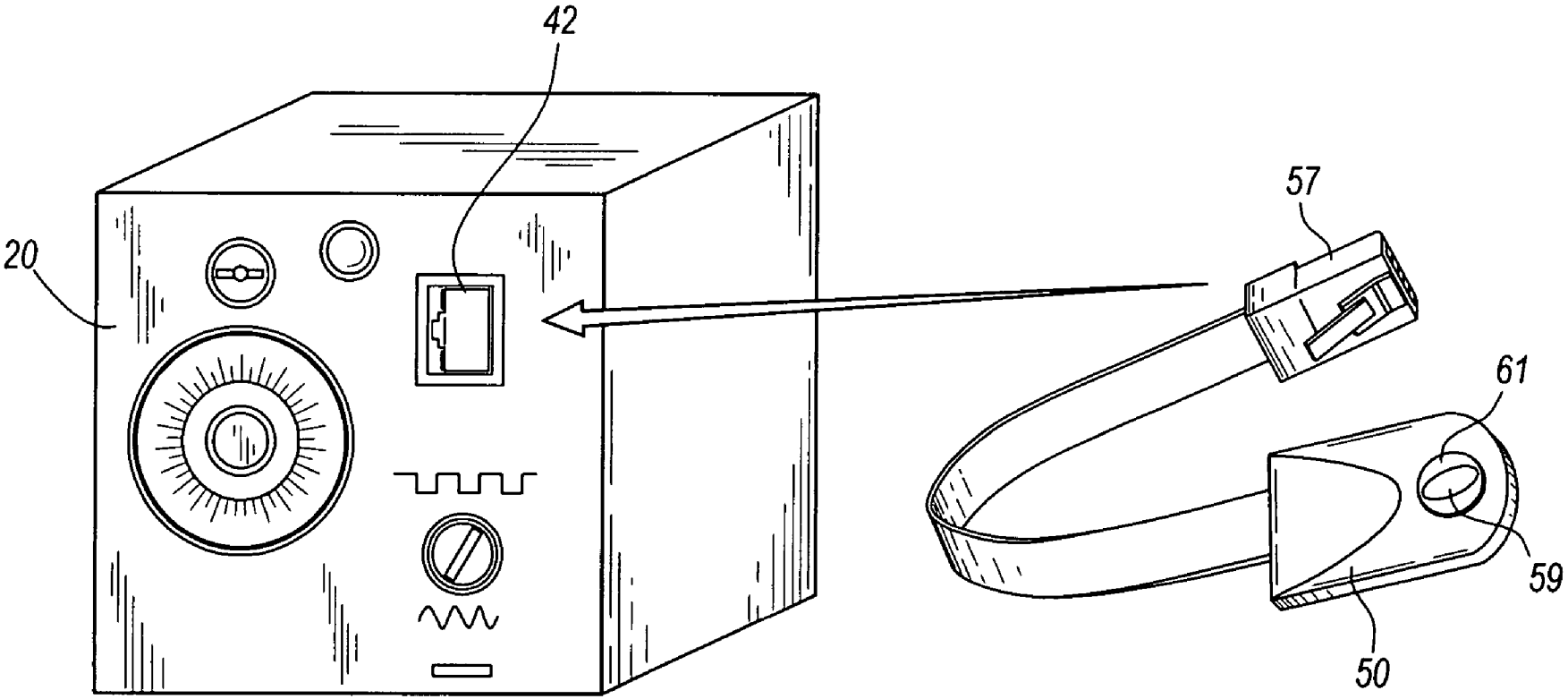
FIG. 3 illustrates one embodiment of the variable-operating device of FIG. 1 and one embodiment of the portable memory device of FIG. 2.

The external output connector 57 of the portable memory device 50 can be connectable to the external access connector 42 of the compressor 20. In some embodiments, the external output connector 57 of the portable memory device 50 can include a RJ45 male connector that is connectable to a RJ45 female connector of the external access connector 42 of the compressor 20. It should be understood that the external output connector 57 and the external access 42 can include other mating connectors and can be connected over a wired connection or a wireless connection. When the external output connector 42 of the portable memory device 50 is engaged with the external access connector 42 of the compressor 20, the portable memory device interface 40 can transmit operating characteristics from the memory module 55 of the portable memory device 50 to the compressor 20. FIG. 3 illustrates one embodiment of the portable memory device 50 connectable with an exemplary compressor 20.

An operator can use the selection mechanism 59 of the portable memory device 50 to start and/or stop the transmitting of operating characteristics from the memory module 55 of the portable memory device 50 to the compressor 20. In some embodiments, the selection mechanism 59 can also be used to set operating characteristics stored in the memory module 55 and/or to select operating characteristics to be transmitted to the compressor 20.

The indicator 61 can include a light emitting diode ("LED") that specifies the current or recent operation of the portable memory device 50. For example, the indicator 61 can light or flash to specify a valid connection or the successful transmission of data to or from an external device, such as the portable memory device interface 40 of the compressor 20.

It should be understood that the portable memory device 50 can include additional components or a subset of the components illustrated and described above. The functionality provided by the components can also be combined and distributed in a variety of configurations.

Figure 4:
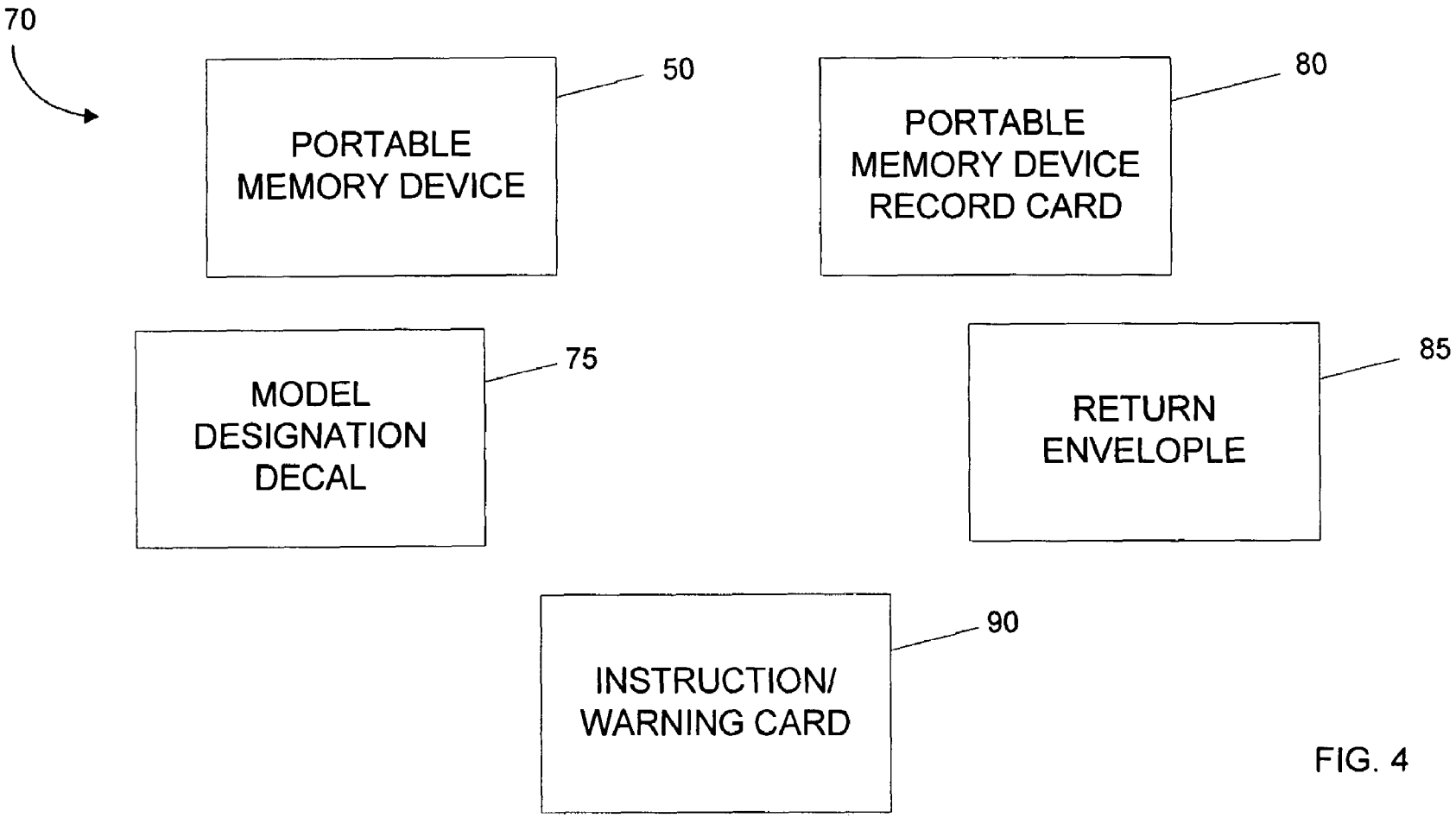
FIG. 4 is a schematic illustration of an exemplary operation modification kit including the portable memory device of FIG. 2.

In some embodiments, the portable memory device 50 is included in an upgrade or reconfiguration kit. FIG. 4 illustrates an exemplary reconfiguration kit 70 that includes the portable memory device 50, a model designation decal 75, a portable memory device record card 80, a return mechanism 85, and a warning and/or instruction card 90. In some embodiments, the return mechanism 85 can include an envelope, box, bag, or shipping packaged that allows a user to return the portable memory device after using the reconfiguration kit 70.

Figure 5:
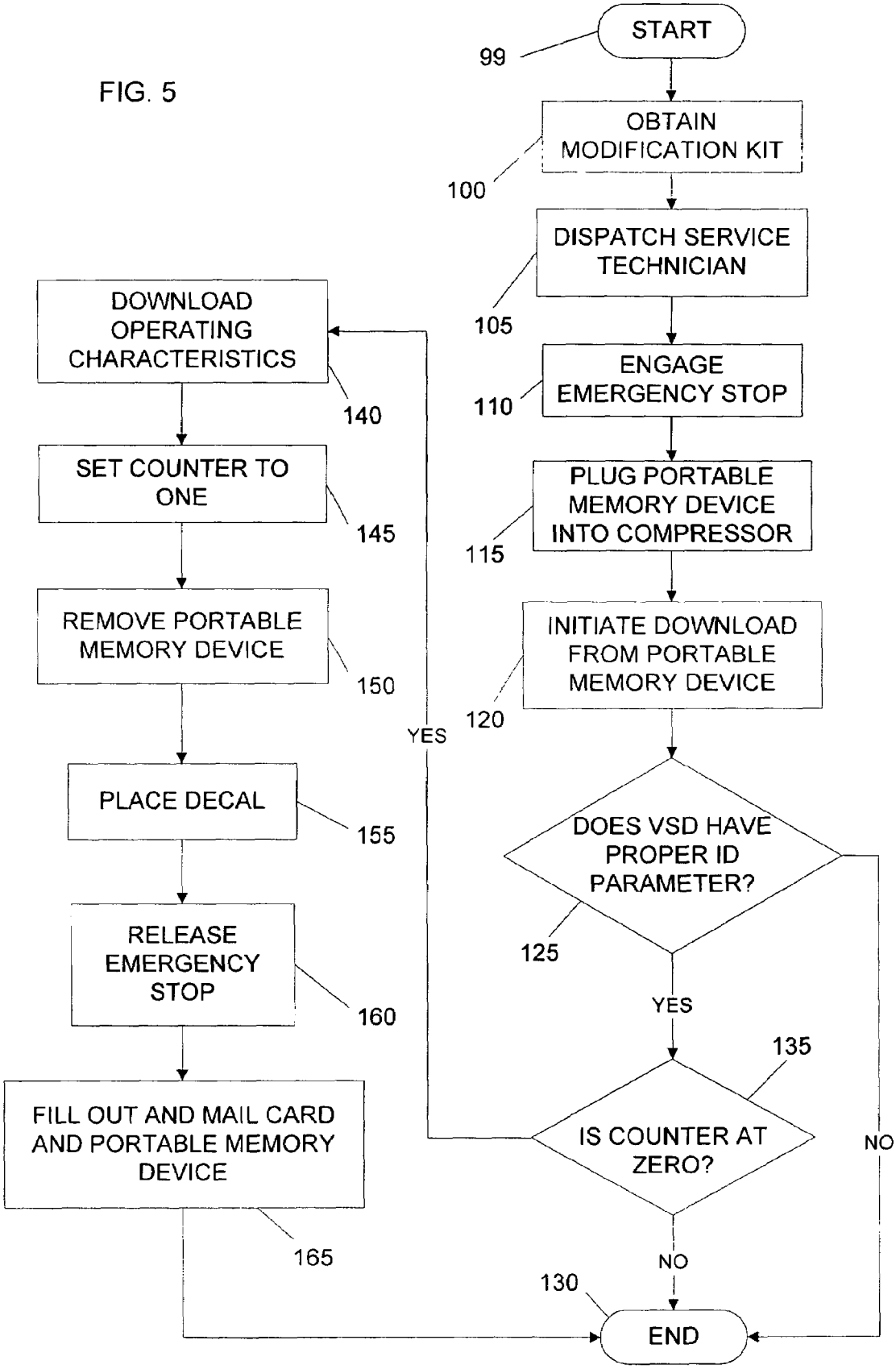
FIG. 5 is a flow chart illustrating an exemplary process of modifying the operation of the variable-operating device of FIG. 1 with the portable memory device of FIG. 2.

FIG. 5 illustrates an exemplary process flow for upgrading the compressor 20 using the reconfiguration kit 70. The process steps illustrated in FIG. 5 are exemplary in order and content, and the processing of upgrading the compressor 20 using the reconfiguration kit 70 can be accomplished with a subset of the depicted steps or additional and alternative steps.

Beginning at start block 99, when a user wants to modify the operating characteristics of the compressor 20 (i.e., change pressure setting, power setting, etc.), the user can purchase and/or obtain the reconfiguration 70 (block 100). In some embodiments, upon purchasing the reconfiguration kit 70, a service technician is dispatched to the site of the compressor 20 to perform the upgrade at block 105. It should be understood the user can perform the upgrade himself or herself in addition to or in place of the service technician.

In some embodiments, the service technician engages an emergency stop of the compressor 20 that prevents the compressor 20 from operating while the upgrade is being performed (block 110). The service technician can engage the emergency stop by pressing a button, changing the position of a switch, or the like. After engaging the emergency stop, the service technician plugs the external output connector 57 of the portable memory device 50, which includes a male RJ45 connector, into the external access connector 42 of the portable memory device interface 40 of the compressor 20, which includes a female RJ45 connector (block 115). At block 120, the service technician depresses the selection mechanism 45 on the portable memory device 50 to initiate the transmitting of the operating characteristics to the compressor 20.

The portable memory device 50 can include safeguards to prevent using the portable memory device 50 in non-compliant compressors. The portable memory device 50 can also include safeguards to prevent multiple uses of the portable memory device 50. For example, the compressor 20 can include an identification parameter. The portable memory device 50 can verify the identification parameter of the compressor 20 before transmitting operating characteristics to ensure that the compressor 20 is compatible with the portable memory device 50 (block 125). In some embodiments, if the compressor 20 includes an invalid identification parameter, operating parameters are not transmitted to the compressor 20, and the modification process ends at block 130. If the compressor 20, however, includes a valid identification parameter, operating characteristics can be transmitted the compressor 20. The portable memory device 50 can also include an identification parameter that is checked by the compressor 20 before operating characteristics are transmitted.

The portable memory device 50 can also include a counter value. The counter value can be used to track use of the portable memory device 50 and to prevent the portable memory device 50 from being used multiple times. In some embodiments, the compressor 20 checks the counter value to ensure that it is set to a predetermined value (e.g., zero) before transmitting operating characteristics at block 135. In some embodiments, if the counter value is not generally equal to the predetermined value (e.g., zero), operating characteristics are not transmitted from the portable memory device 50 and the modification process ends (block 130). If the counter value is set or equal to the predetermined value (e.g., zero), however, operating characteristics can be transmitted from portable memory device 50 to the compressor 20 (block 140).

After transmitting the operating characteristics to the compressor 20, the portable memory device 50 can be marked as used by modifying the counter value (e.g., setting the counter value to one) (block 145). In some embodiments, by marking the portable memory device 50 as used, the portable memory device 50 cannot be used again to upgrade or modify a compressor 20.

In some embodiments, the operating characteristics transmitted from the portable memory device 50 are forwarded to the VSD 30 over the connection 45. It should be understood that the compressor 20 or, more particularly, the portable memory device interface 40 can process the operating characteristics transmitted from the portable memory device 50 before forwarding the operating characteristics to the VSD 30.

Upon receiving the operating characteristics, the VSD 30 can use the operating characteristics to set and/or modify its operating parameters (block 125). In some embodiments, the VSD 30 stores operating parameters based on the operating characteristics to the memory 32. The VSD 30 can overwrite existing (if any) operating parameters previously stored in the memory 32. The VSD 30 can also select a particular operating parameter configuration from the memory 32 based on the operating characteristics. The compressor 20, or more particularly, the VSD 30, then operates as modified by the operating characteristics.

Once the compressor 20 has been modified or upgraded, the technician removes the portable memory device 50 from the portable memory device interface 40 of the compressor 20 (block 150). The service technician then installs the new model designation decal 75 over the existing decal on the package at block 155. In some embodiments, the service technician installs a new model designation decal over the existing decal to ensure that a user is aware of the operating characteristics of the compressor 20. The warning/instruction card 90 can also include a safety statement regarding the modified operating parameters of the compressor 20 set by the operating characteristics transmitted from the portable memory device 50. In some embodiments, a user may not safely operate the compressor 20 if the user is unaware of the current operating characteristics of the compressor 20.

The service technician then disengages the emergency stop of the compressor 20 so that the compressor 20 can be operated again (block 160). As previously described, the service technician can disengage the emergency stop by pressing a button, changing the position of the switch, or the like.

The service technician can fill in appropriate information on the portable memory device record card 80, and can mail the portable memory device 50 and record card 80 in the self addressed return envelope 85 to an entity associated with the provider of the portable memory device 50, such as a distribution center or service center (block 165). The shape and size of the portable memory device 50 can configured such that it can be conveniently mailed in the return envelope 85. In some embodiments, the portable memory device 50 can have a length of 1.5 inches, a width of 1.0 inch, and a thickness of 0.2 inches. It should be understood, however, that the size and shape of the portable memory device 50 can be different depending on the compressor 20 that the portable memory device 50 connects to.

After the service technician mails the portable memory device 50 and portable memory device record card 80, the modification process is complete (block 130). An entity associated with the provider of the portable memory device 50 can use returned portable memory device record cards 80 to track sales and user preferences for compressor operating characteristics. The entity associated with the provider of the portable memory device 50 can also reload operating characteristics to returned portable memory devices 50. The entity can have a 'black box' that can be used to modify operating characteristics stored in the portable memory device 50. The 'black box' can also be used to modify safety features of the portable memory device 50, such as an identification parameter and/or a counter value. The 'black box' can include a non-operational drive that has operating characteristics stored in it. The portable memory device 50 can be plugged into the 'black box,' and the 'black box' can store operating parameters and/or safety features in the portable memory device 50. In some embodiments, the 'black box' can overwrite existing operating characteristics and/or safety features stored in the portable memory device 50. The modified portable memory device 50 can then be re-kitted in a reconfiguration kit 70 and reused.

It should be understood that the above process of modifying the operating characteristics of the compressor 20 can be performed an infinite number of times and can take place before the compressor 20 is sold or installed or after the compressor 20 has been installed and/or used.

The portable memory cards 50 can also be used at distribution centers to set operating characteristics of compressors 20 as requested. For example, compressors 20 can be shipped from the factory to distribution centers with a base set of operating parameters that operate the compressor 20 at one of multiple operating configurations. Distribution centers can stock base configuration compressors 20 and when an order is received they can use the portable memory device 50 to configure a base configuration compressor 20 to the exact model ordered. By setting operating characteristics as requested, distribution centers do not need to forecast or estimate the number of each model of compressor 20 to keep in stock to service customer requests. Distribution centers can keep portable memory devices 50 with possible operating characteristics in stock and configure compressors 20 to order. A distribution center can also include a single portable memory device 50 and can include a 'black box' as described above to store requested operating characteristics to the portable memory device 50 as needed. In some embodiments, the portable memory devices 50 stocked by the distribution centers do not include one or more of the safety features described above and can be used more than once. The portable memory devices 50 stocked by the distribution centers can, however, include a counter value to track the number of compressors 20 configured by the portable memory device 50 for inventory and/or sales purposes.

The portable memory device 50 can also be used in combination with the portable memory device interface 40 as a diagnostic/trending tool. The compressor 20 can transmit operational information, such as operating duration times, operating characteristics, sensor outputs, error conditions or warnings, etc., to the portable memory device 50. The portable memory device 50 can then be provided to an entity associated with the provider of the portable memory device 50 to provide in-field use data, service recommendations, etc.

It should be understood that the portable memory device 50 can also remain connected to the compressor 20 while it operates. In some embodiments, as described above, the compressor 20 can transmit operational information to the portable memory device 50 for later diagnostic, sales, marketing, etc., analysis.

It should also be understood that the portable memory device 50 can be a removable device such that the compressor 20 can operate when the portable memory device 50 is not connected. In other embodiments, however, the compressor 20 can only operate when the portable memory device 50 is connected. For example, the compressor 20 can use operating characteristics stored in the portable memory device 50 directly, as needed, rather than transmitting the operating characteristics and storing them internally to the memory 32.

Various features and advantages of the invention are set forth in the following claims.

The invention claimed is:

1. A system for modifying the operation of a compressor, the system comprising a compressor controller configured to operate the compressor according to operating parameters;

a portable memory device including a counter to track use of the portable memory device; and a first portable memory device interface configured to transmit information between the portable memory device and the compressor controller and to set the counter;

the portable memory device configured to be connected to the first portable memory device interface; and the compressor controller configured to modify the operating parameters based on the information and to operate the compressor according to the modified operating parameters.

2. A system as claimed in claim 1, wherein the portable memory device is further configured to be disconnected from the first portable memory interface after transmitting the information.

3. A system as claimed in claim 2, wherein the compressor controller is configured to operate the compressor according to the modified operating parameters after the portable memory device is disconnected from the first portable memory interface.

4. A system as claimed in claim 1, wherein the compressor controller is configured to operate the compressor according to the modified operating parameters while the portable memory device is connected to the first portable memory interface.

5. A system as claimed in claim 2, wherein the portable memory device is further configured to be connected to a second portable memory device interface.

6. A system as claimed in claim 1, wherein the information includes operating characteristics configured to set the operating parameters of the compressor.

7. A system as claimed in claim 1, wherein the information includes operational information of the compressor.

8. A system as claimed in claim 1, wherein the first portable memory device interface includes an external access connector.

9. A system as claimed in claim 1, wherein the portable memory device includes an external output connector.

10. A system as claimed in claim 1, further comprising a memory configured to store the operating parameters.

11. A system as claimed in claim 1, wherein the portable memory device includes a selection mechanism configured to initiate the transmission of information.

12. A system as claimed in claim 1, wherein the portable memory device includes an indicator configured to specify operation of the portable memory device.

13. A method of modifying the operation of a first device, the method comprising:

connecting a portable memory device to the first device, the portable memory device including a counter value to track use of the portable memory device;

transmitting information between the portable memory device and the first device;

modifying operating parameters of the first device based on the information;

setting the counter value of the portable memory device;

disconnecting the portable memory device from the first device; and operating the first device with the modified operating parameters.

14. A method as claimed in claim 13, further comprising returning the portable memory device to an entity associated with a provider of the portable memory device.

15. A method as claimed in claim 13, further comprising modifying information stored in the portable memory device.

16. A method as claimed in claim 13, further comprising connecting the portable memory device to a second device.

17. A method as claimed in claim 13, wherein the information includes operating characteristics configured to set the operating parameters of the first device.

18. A method as claimed in claim 13, wherein the information includes operational information of the first device.

19. A method as claimed in claim 13, further comprising initiating transmission of information between the portable memory device and the first device with a selection mechanism of the portable memory device.

20. A method as claimed in claim 13, further comprising engaging an emergency stop of the first device.

21. A method as claimed in claim 20, further comprising disengaging the emergency stop of the first device.

22. A method as claimed in claim 13, further comprising verifying an identification parameter.

23. A method as claimed in claim 22, wherein the identification parameter is included with the first device.

24. A method as claimed in claim 22, wherein the identification parameter is included with the portable memory device.

25. A method of modifying the operation of a device, the method comprising:

obtaining a first reconfiguration kit, the first reconfiguration kit including a portable memory device;

connecting the portable memory device to the device;

transmitting information between the portable memory device and the device;

disconnecting the portable memory device from the device; and returning the portable memory device to an entity associated with the provider of the portable memory device.

26. A method as claimed in claim 25, wherein the first reconfiguration kit further includes a model designation decal.

27. A method as claimed in claim 26, further comprising installing the model designation decal.

28. A method as claimed in claim 25, wherein the first reconfiguration kit further includes a portable memory device record card.

29. A method as claimed in claim 28, further comprising filling out the portable memory device record card.

30. A method as claimed in claim 28, further comprising returning the portable memory device record card to an entity associated with a provider of the portable memory device.

31. A method as claimed in claim 25, wherein the first reconfiguration kit further includes a return mechanism.

32. A method as claimed in claim 31, wherein returning the portable memory device includes returning the portable memory device using the return mechanism.

33. A method as claimed in claim 25, further comprising initiating transmission of information between the portable memory device and the device with a selection mechanism included with the portable memory device.

34. A method as claimed in claim 25, further comprising engaging an emergency stop of the device.

35. A method as claimed in claim 34, further comprising disengaging the emergency stop of the device.

36. A method as claimed in claim 25, further comprising setting a counter value of the portable memory device after transmitting the information.

37. A method as claimed in claim 25, further comprising verifying an identification parameter before transmitting the information.

38. A portable memory device comprising:

a memory module configured to store a counter value for tracking use of the portable memory device;

an external output connector connectable with an external access connector of a device and configured to transmit information between the device and the memory module when the external output connector is connected to the external access connector of the device.

39. A portable memory device as claimed in claim 38, wherein the memory module is further configured to store operating characteristics to modify operating parameters of the device.

40. A portable memory device as claimed in claim 38, wherein the memory module is further configured to store operational information of the device.

41. A portable memory device as claimed in claim 38, further comprising a selection mechanism configured to allow a user to initiate transmission of information.

42. A portable memory device as claimed in claim 41, wherein the selection mechanism is further configured to allow a user to select information to transmit.

43. A portable memory device as claimed in claim 41, wherein the selection mechanism is further configured to allow a user to store information to the memory.

44. A portable memory device as claimed in claim 38, further comprising an indicator configured to specify operation of the portable memory device.

45. A portable memory device as claimed in claim 38, wherein the memory module is further configured to store an identification parameter.

* * * * *